US005873584A

United States Patent [19]

Wrike

[11] Patent Number: 5,873,584

[45] Date of Patent: Feb. 23, 1999

[54] IN-LINE ROLLER SKATE FRAME

[75] Inventor: Michael C. Wrike, Jamestown, N.C.

[73] Assignee: Rike Inline, Inc., Jamestown, N.C.

[21] Appl. No.: 946,256

[22] Filed: Oct. 7, 1997

Related U.S. Application Data

[63] Continuation of Ser. No. 373,660, Jan. 17, 1995, abandoned.

[51] Int. Cl.[6] ..... A63C 17/06

[52] U.S. Cl. ..... 280/11.22; 280/11.27

[58] Field of Search ..... 280/11.22, 11.23, 280/11.27

[56] References Cited

U.S. PATENT DOCUMENTS

| | | | |
|---|---|---|---|
| D. 354,539 | 1/1995 | Meibock et al. | D21/226 |
| 1,530,211 | 3/1925 | Siemnash | 280/11.22 X |
| 1,960,234 | 5/1934 | Eckels | 280/11.22 |
| 3,086,787 | 4/1963 | Wyche | 280/11.23 X |
| 3,880,441 | 4/1975 | Silver . | |
| 3,900,203 | 8/1975 | Kukulowicz . | |
| 3,999,772 | 12/1976 | Brennan | 280/11.23 |
| 4,058,324 | 11/1977 | Dallaire | 280/11.22 |
| 4,418,929 | 12/1983 | Gray . | |
| 4,657,265 | 4/1987 | Ruth . | |
| 4,659,095 | 4/1987 | Halvorsen . | |
| 4,666,169 | 5/1987 | Hamill et al. . | |
| 4,932,675 | 6/1990 | Olson et al. . | |
| 5,046,746 | 9/1991 | Gierveld . | |
| 5,092,614 | 3/1992 | Malewicz . | |
| 5,129,663 | 7/1992 | Soo . | |
| 5,184,834 | 2/1993 | Yu . | |
| 5,193,827 | 3/1993 | Olson . | |
| 5,199,726 | 4/1993 | Willett . | |
| 5,251,920 | 10/1993 | McHale . | |
| 5,253,884 | 10/1993 | Landers . | |
| 5,271,633 | 12/1993 | Hill, Jr. . | |
| 5,277,437 | 1/1994 | Moats . | |
| 5,314,199 | 5/1994 | Olson et al. . | |
| 5,331,752 | 7/1994 | Johnson et al. . | |
| 5,452,907 | 9/1995 | Meibock et al. | 280/11.22 |
| 5,503,413 | 4/1996 | Belogour | 280/11.22 |
| 5,549,310 | 8/1996 | Meibock et al. | 280/11.22 |

FOREIGN PATENT DOCUMENTS

| | | | |
|---|---|---|---|
| 93985 | 11/1962 | Denmark | 280/11.22 |
| 2566672 | 1/1986 | France | 280/11.22 |

*Primary Examiner*—Peter C. English

*Attorney, Agent, or Firm*—Myers, Bigel, Sibley & Sajovec

[57] ABSTRACT

An in-line roller skate has a wheel frame that includes replaceable sidewalls. The in-line roller skate includes a boot having a sole surface with toe and heel portions, a wheel frame, and a plurality of wheels rotatably mounted within the wheel frame. The wheel frame includes a toe plate which is affixed to the toe portion of the sole surface, a heel plate which is affixed to the heel portion of the sole surface, and first and second spaced-apart, downwardly extending sidewalls that are devoid of transverse projections. The frame is formed by releasably attaching the first and second sidewalls to the respective lateral faces of the toe and heel plates.

12 Claims, 4 Drawing Sheets

IN-LINE ROLLER SKATE FRAME

This application is a continuation of application Ser. No. 08/373,660, filed Jan. 17, 1995, abandoned.

FIELD OF THE INVENTION

The present invention relates to in-line roller skates, and more particularly to the frames for carrying the wheels of such roller skates.

BACKGROUND OF THE INVENTION

An in-line roller skate typically comprises a boot, a frame attached to the boot, and a plurality of wheels in serial longitudinal alignment attached to the frame via transversely-disposed axles. The frame typically includes a toe plate, a heel plate, and a pair of laterally spaced-apart, downwardly-extending sidewalls. The skate wheels reside in the cavity formed between the sidewalls and below the toe plate and heel plate. Most commonly, the frame is formed by casting or machining as a single integral component.

In-line skates are used in a variety of activities, including roller hockey, racing, and recreational skating. As the number and variety of activities for in-line skates has grown, the materials and designs for skate components have become quite specialized. For instance, on many skates the optimum wheel size varies as a function of the activity for which the skate is used. As another example, many recently developed frames are formed out of a single, thin piece of lightweight metal or synthetic material that minimizes overall skate weight, thereby reducing the fatigue experienced by the skater.

Many in-line roller skating activities subject the wheel frames to significant, and potentially damaging, stress levels. For example, when in-line roller skates are used by roller hockey players, conventional lightweight frames can be bent or fractured when struck by a hockey stick, the hockey puck, or another skate. The sidewall components of the frame that form the wheel cavity and receive the wheel axles are particularly susceptible to such damage.

If a sidewall on a conventional in-line roller skate having a one-piece wheel frame is damaged, the sidewall alone cannot be replaced; instead, the entire frame must be replaced. This is a significant drawback, because presently available frames are typically quite expensive due to both the costs associated with casting or machining the single-piece frame and the high price of the lightweight materials used to construct these frames. In addition, skaters who use their skates for several different activities also face frame replacement difficulties, as a separate frame is often required to accommodate the different sized wheels that provide optimum performance for each different activity.

In-line roller skates including multiple-piece frames have been suggested in the prior art, as evidenced, for example, by the skate designs disclosed in U.S. Pat. No. 5,277,437 to Moats, U.S. Pat. No. 4,666,169 to Hamill et al., and U.S. Pat. No. 4,418,929 to Gray. As such, these designs permit the replacement of damaged sidewalls without replacement of the entire frame. However, these prior art frames use sidewalls that include cross-members or other lateral projections to provide rigidity and strength to the frame. Increased strength improves the durability of the frame, while increased rigidity can improve skate responsiveness. The inclusion of such lateral projections necessitates either machining or separately casting each sidewall in the manufacturing process, and thus the cost of manufacturing an individual sidewall can be quite high. An additional disadvantage of these multi-piece frame configurations is that their sidewalls are configured for a specific side of the skate; thus it is necessary to have both a left and right spare sidewall available.

Several additional difficulties with presently available in-line roller skate frames relate to the impact that performance-enhancing design modifications have had on the skate's durability and manufacturing cost. For example, frame configurations such as the skate disclosed in U.S. Pat. No. 5,092,614 to Malewicz allege to have improved skate performance by decreasing the weight of the frame. However, modifying the frame to decrease weight generally decreases the strength and durability of the frame, increases the cost of producing it, or both. Similarly, almost all conventional frames include lateral cross members that increase the skates rigidity to provide increased speed and responsiveness. However, forming sidewalls that include such cross members requires machining or casting in the manufacturing process, which can significantly increase the cost of manufacturing the sidewall.

SUMMARY OF THE INVENTION

In view of the foregoing background, it is an object of the present invention to provide an in-line roller skate having a frame that includes sidewalls that can be easily and inexpensively replaced when damaged.

It is another object of the present invention to provide an in-line roller skate frame that can be reconfigured to accommodate wheels of various diameters.

These and other objects, features and advantages of the present invention are provided by an in-line roller skate having a wheel frame that includes replaceable sidewalls. The in-line roller skate comprises a boot having a sole surface with toe and heel portions, a wheel frame, and a plurality of wheels rotatably mounted within the wheel frame. The wheel frame includes a toe plate which is affixed to the toe portion of the sole surface, a heel plate which is affixed to the heel portion of the sole surface, and first and second spaced-apart, downwardly-extending sidewalls that are devoid of transverse projections. The frame is formed by releasably attaching the first and second sidewalls to the respective lateral faces of the toe and heel plates.

In the preferred embodiment of the present invention, depending from the lower surface of both the toe plate and heel plate are first and second laterally spaced-apart, downwardly-extending flanges. In this embodiment, the wheel frame is formed by releasably attaching the first sidewall to the outer lateral faces of the respective first toe and heel plate flanges, and by similarly releasably attaching the second sidewall to the outer lateral faces of the respective second toe and heel plate flanges. This configuration provides increased lateral thickness along the portion of the frame adjacent to the sole of the boot, which results in increased frame rigidity. This additional rigidity at the sole-frame junction can improve the speed and responsiveness of the in-line roller skate.

The present invention allows users to replace one or both sidewalls without replacing the other components of the wheel frame. As a result, the user can inexpensively replace damaged sidewalls, easily reconfigure the skate to carry wheels of a different diameter, and use sidewalls with anodic coatings of different colors. Additionally, as the sidewalls in the present invention are devoid of lateral projections; they can be manufactured by simple machining operations (rather than by casting), and further can be formed of titanium or other lightweight, high-durability materials that are difficult to machine.

BRIEF DESCRIPTION OF THE DRAWING

FIG. 3 is a perspective view of the wheels and sidewalls of the skate frame.

FIG. 4 is a side view of the wheels and a skate frame sidewall that has been damaged during use.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The present invention relates to an in-line skate frame and associated method for replacing an in-line skate frame. In the description of the present invention that follows, certain terms are employed to refer to the positional relationship of certain structures relative to other structures. As used herein, the term "longitudinal" and derivatives thereof refer to the general direction defined by the longitudinal axis of the boot or other footwear of the in-line skate that extends between the toe and the heel of the boot. As used herein, the terms "outer", "outward", "lateral", and derivatives thereof refer to the direction defined by a vector originating at the longitudinal axis of the boot and extending horizontally and perpendicularly thereto. Conversely, the terms "inner", "inward", and derivatives thereof refer to the direction opposite that of the outward direction. Together, the inward and outward directions comprise the "transverse" dimension.

Figure 1:
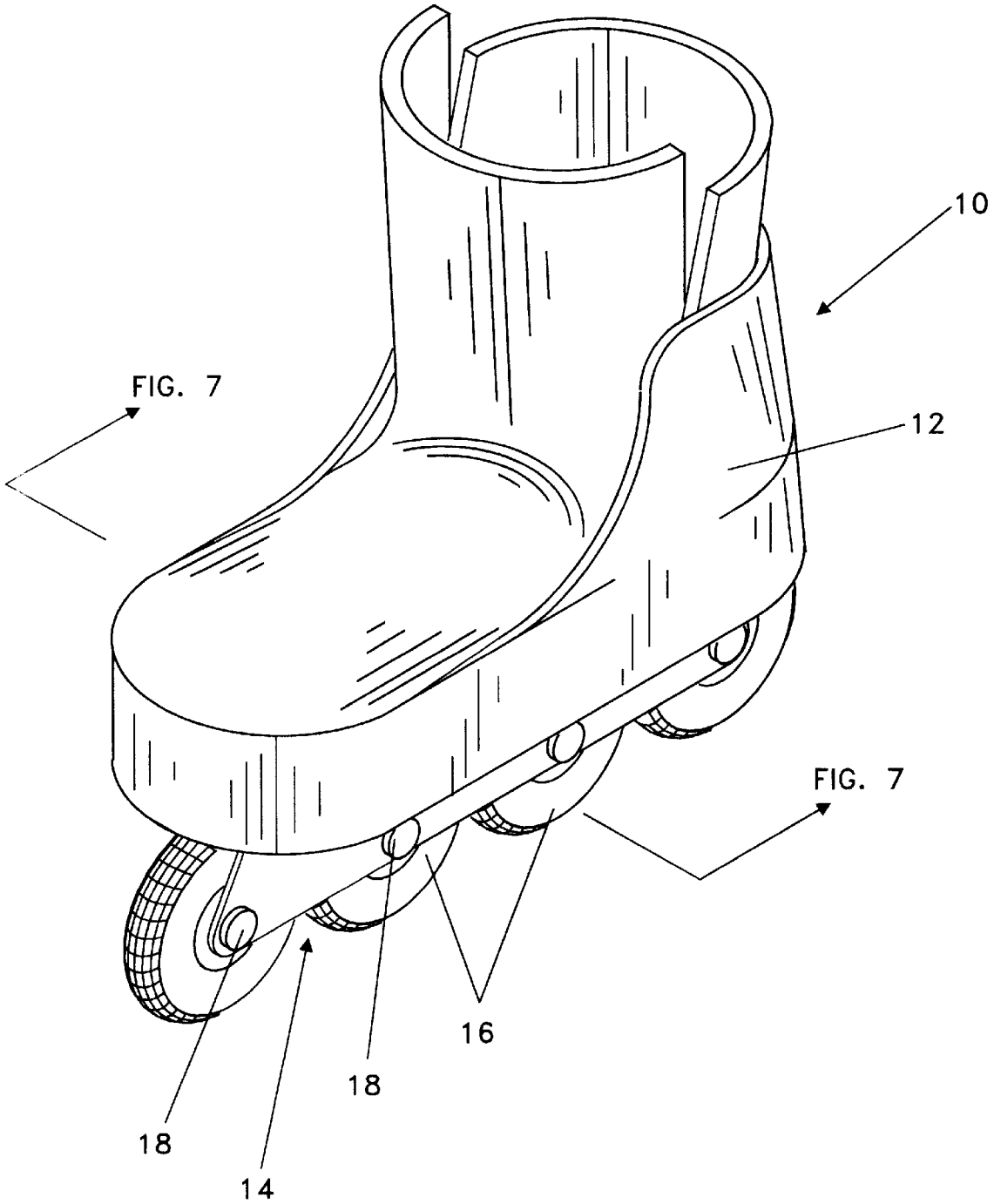
FIG. 1 is a perspective view of an assembled in-line roller skate showing the boot, the wheel frame, and the wheels.

Referring now to the drawings, an in-line roller skate according to the present invention, generally designated at 10, is illustrated in FIG. 1. The skate 10 includes a boot 12 (which can also be a shoe or other similar footwear), a frame 14 attached thereto, and a plurality (e,g., three to six) of wheels 16 that are rotatably and removably mounted on frame 14 for rotation about their respective axles 18.

Figure 2:
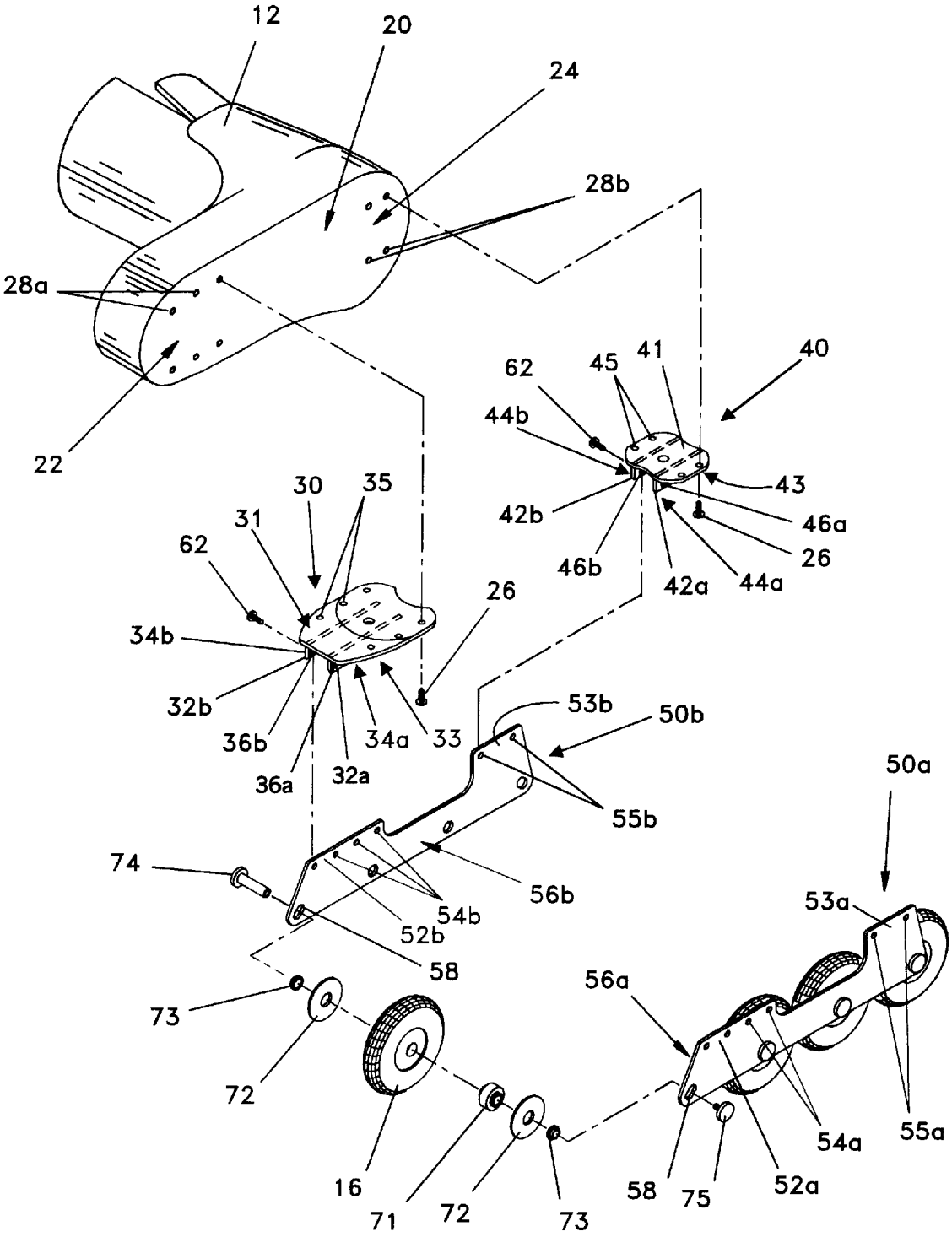
FIG. 2 is an exploded perspective view of the in-line roller skate illustrating the interconnection of the wheels, frame components, and boot.

Referring now to the exploded view of FIG. 2, the boot 12 includes a sole surface 20 having a toe portion 22 and a heel portion 24 to which the frame 14 is affixed. A bolt 26 is inserted through each of a plurality of openings 35 disposed about the horizontal surface of a toe plate 30. These bolts 26 are then inserted into matching threaded openings 28*a* disposed along the toe portion 22 of the sole surface, thereby securely attaching the toe plate 30 to the toe portion 22 of the sole surface 20. Bolts 26 are similarly inserted through each of a plurality of openings 45 disposed about the horizontal surface of a heel plate 40 component of the frame, and are inserted into matching threaded openings 28*b* disposed along the heel portion 24 of the sole surface 20. However, as would be readily understood by those skilled in this art, other alternative fastening means, such as rivets or high-strength adhesives, can be used to secure the wheel frame 14 to the sole surface of the boot.

Figure 7:
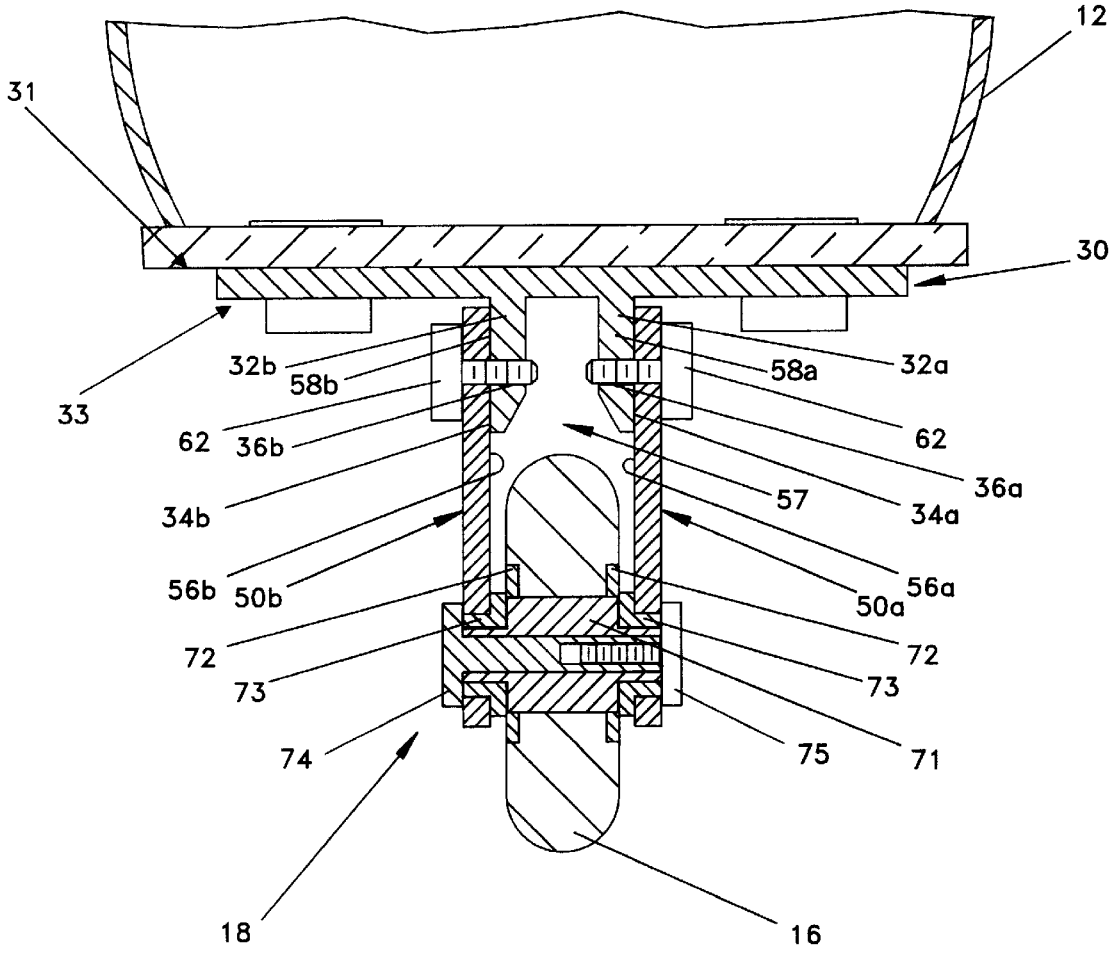
FIG. 7 is a cross-sectional view of the wheel frame taken along line 7—7 of FIG. 1.

As is further shown in FIG. 2, and as shown in FIG. 7, the wheel frame 14 includes the toe plate 30, the heel plate 40, and a pair of sidewalls 50*a*, 50*b*. The toe plate 30, which has an upper face 31 and a 20 lower face 33, includes along the lower face 33 a pair of downwardly-extending flanges 32*a*, 32*b*, which extend longitudinally virtually the entire length of toe plate 30. A plurality of transversely spaced-apart apertures 36*a*, 36*b* are included along the lateral faces 34*a*, 34*b* of respective flanges 32*a*, 32*b*. Although the illustrated toe plate 30 having flanges 32*a*, 32*b* is preferred, those skilled in this art will appreciate that other configurations, such as a downwardly-extending block, that provides lateral faces for attachment to the sidewalls 50*a*, 50*b* can be used with the present invention.

The heel plate 40, which has an upper face 41 and a lower face 43, similarly includes along its lower face 43 downwardly-extending flanges 42*a*, 42*b*, which extend longitudinally virtually the entire length of heel plate 40. A plurality of transversely spaced-apart apertures 46*a*, 46*b* are included along the lateral faces 44*a*, 44*b* of respective flanges 42*a*, 42*b*. Although the illustrated heel plate 40 having flanges 42*a*, 42*b* is preferred, those skilled in this art will appreciate that other configurations, such as a downwardly-extending block, that provides lateral faces for attachment to the sidewalls 50*a*, 50*b* can be used with the present invention.

The toe plate 30 and the heel plate 40 are preferably constructed out of a relatively lightweight, low cost material, such as aluminum. Further, it is desirable that the toe plate 30 and heel plate 40 be constructed from a material that is easily machined, such as aluminum, which can simplify their manufacture.

Referring again to FIG. 2, sidewalls 50*a*, 50*b* each include along their respective upper forward portions 52*a*, 52*b* a plurality of longitudinally spaced-apart apertures 54*a*, 54*b*. The sidewalls 50*a*, 50*b* similarly each include a plurality of longitudinally spaced-apart apertures 55*a*, 55*b* along their respective upper rear portions 53*a*, 53*b*. These apertures 54*a*, 54*b*, 55*a*, 55*b* are spaced so as to overlie the threaded apertures 36*a*, 36*b*, 46*a*, 46*b* included along the lateral faces 34*a*, 34*b*, 44*a*, 44*b* of the respective toe and heel plate flanges 32*a*, 32*b*, 42*a*, 42*b*. Notably, the sidewalls 50*a*, 50*b* are devoid of transverse projections and are substantially structurally identical, which allows them to be interchangeable.

The in-line roller skate 10 is illustrated in FIGS. 1 and 7 with the sidewalls 50*a*, 50*b* attached to the toe 30 and heel 40 plates to form the complete frame 14. FIGS. 2 and 3 illustrate the skate 10 in an unassembled position, with sidewalls 50*a*, 50*b* detached from the other components of the frame 14. The frame 14 is constructed by attaching the inside face 56*a* of the sidewall 50*a* to the outside faces 34*a* and 44*a* of the toe and heel plate flanges 32*a* and 42*a*, and by similarly attaching the inside face 56*b* of sidewall 50*b* to the outside faces 34*b*, 44*b* of toe and heel plate flanges 32*b*, 42*b*. The sidewalls 50*a*, 50*b* are attached to the toe and heel plate flanges by a plurality of bolts 62; these bolts 62 are inserted through the apertures 54*a*, 54*b*, 55*a*, 55*b* along the upper portions 52*a*, 52*b*, 53*a*, 53*b* of the respective sidewalls 50*a*, 50*b* and are further inserted into threaded openings 36*a*,

36*b*, 46*a*, 46*b*. As will be readily understood by those skilled in the art, other releasable fastening means can be employed to releasably attach sidewalls 50*a*, 50*b* to toe plate 30 and heel plate 40.

When the frame 14 is assembled, the sidewalls 50*a*, 50*b*, along with the toe plate 30 and the heel plate 40, define a cavity 57 within which the wheels 16 of the skate 10 reside. Sidewalls 50*a*, 50*b* each include along their respective lower portions a plurality of longitudinally spaced-apart openings 58, each of which receives one of a plurality of wheel axles 18. The skate wheels 16 are then rotatably mounted upon the wheel axles 18. Each wheel 16 (FIG. 7) includes a bearing 71 that extends transversely through its center through which an axle 18 extends and a pair of hubs 72 that circumferentially surround opposite ends of the bearing 71. Spacers 73 separate the axle 18 from openings 58 in each side wall 50*a*, 50*b*. The axle 18 comprises a shaft portion 74 having a hollow threaded end and a bolt portion 75 that is inserted into the threaded end of the shaft portion 74.

Those skilled in this art will appreciate that, although the wheel configuration illustrated herein is preferred, other wheel configurations are also suitable for use with the present invention. Preferably, the wheels are formed from urethane or another polymeric material, but can also be formed of metal, wood, or the like, or a composite of such materials. Further, the exemplary in-line roller skate 10 could include more, or fewer, than the four wheels 16 illustrated herein, and could also include multiple wheels rotatably mounted upon each axle 18.

As is best illustrated in FIG. 3, the frame sidewalls 50*a*, 50*b* according to the present invention are devoid of lateral projections. This configuration greatly simplifies their manufacture; the sidewalls 50*a*, 50*b* can be formed by simply cutting the appropriate shape from sheet metal or other material rather than requiring additional machining steps. As a result, lightweight, high durability materials, such as titanium, that can improve skate performance significantly but which are difficult to machine, can be employed, and machining that alters the thickness of the sheet material is not required in the forming process. Although machined sidewalls 50*a*, 50*b* are preferred, other manufacturing methods for forming the sidewalls 50*a*, 50*b*, such as casting, can also be employed.

Figure 5:
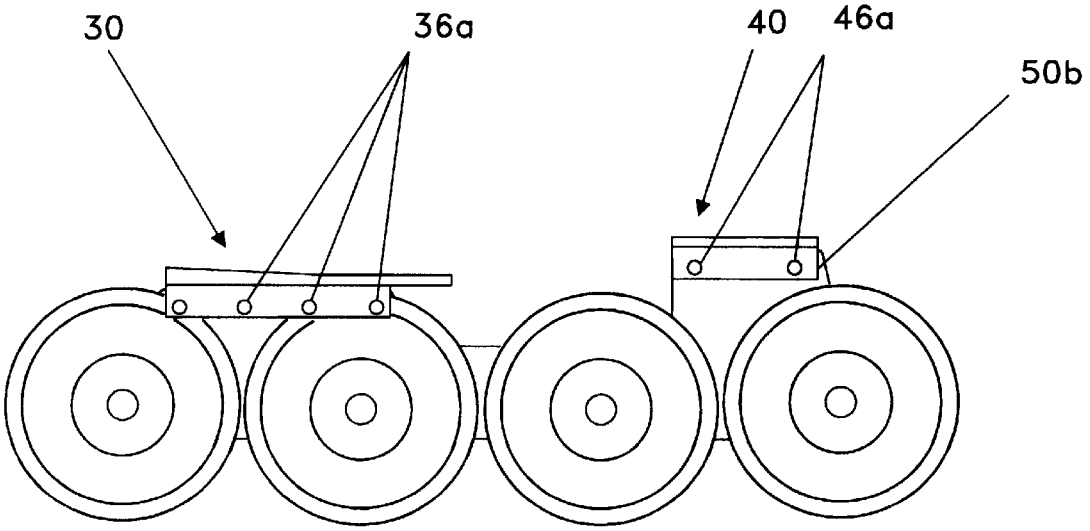
FIG. 5 is a side view of the wheels and a sidewall having been removed.
Figure 6:
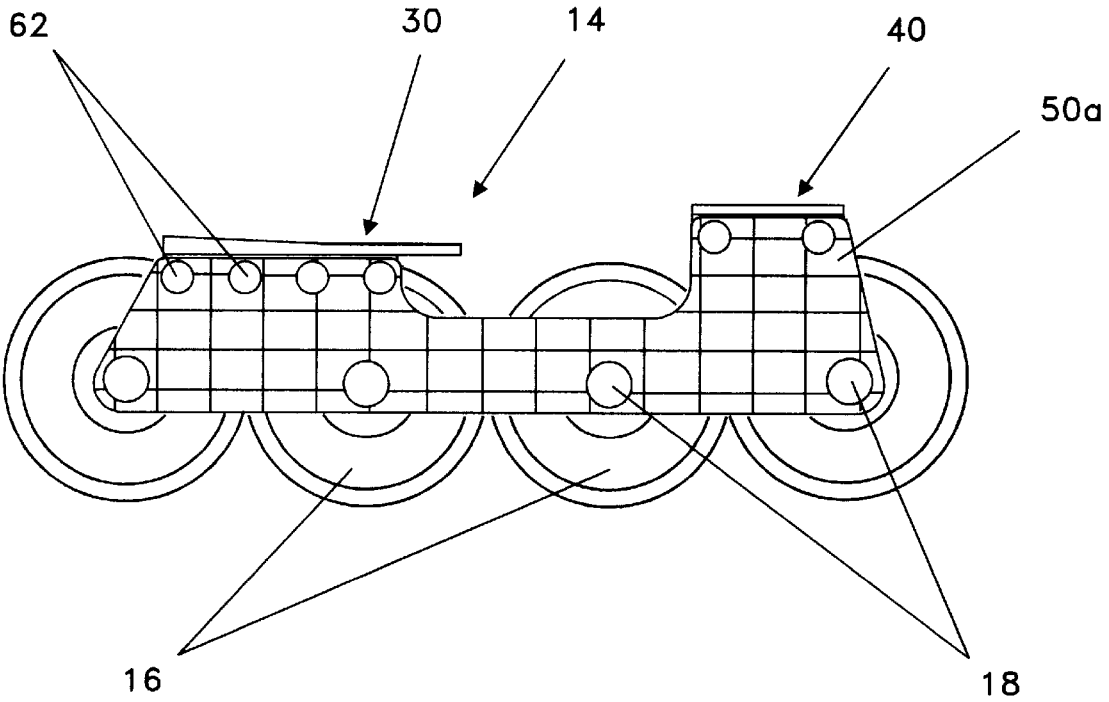
FIG. 6 is a side view of the wheels and a skate frame sidewall similar to FIG. 5, but illustrating an alternative embodiment where the sidewall has been given a colored anodic coating.

As is schematically illustrated in FIG. 4, the sidewalls 50*a*, 50*b* are susceptible to damage during use of the in-line skate 10, particularly when formed from certain lightweight but less durable materials. The employment of releasably attachable sidewalls 50*a*, 50*b* enables damaged sidewalls 50*a*, 50*b* to be replaced without requiring replacement of the entire frame assembly 14. Further, the use of sidewalls 50*a*, 50*b* that are devoid of lateral projections and hence simple to manufacture permits the relatively inexpensive replacement of damaged sidewalls 50*a*, 50*b*. The original sidewall (illustrated as 50*a* in FIG. 4) is unfastened from the skate frame 14. The other sidewall 50*b*, the toe plate 30, the heel plate 40, and the wheels 16 remain in place (FIG. 5). A replacement sidewall 50*a* is then provided and attached to toe plate 30 and heel plate 40 to complete reassembly of the frame 14 (FIG. 6). This replacement technique is advantageous over prior art methods because the entire frame 14 need not be removed from the boot 12 (an action that can weaken the frame-boot junction). This repair technique also saves time in that the wheels 16 are detached from only one sidewall 50*a* rather than from both. These same advantages are realized if an undamaged skate frame is to be replaced for performance or appearance reasons. Further, because the sidewalls 50*a*, 50*b* are substantially structurally identical (which results from the absence of lateral projections thereon), skaters no longer need to carry with them both left and right side replacement sidewalls.

An additional advantage provided by the present invention is that the skate frame 14 has increased lateral thickness in the region where the flanges of the toe and heel plates 30, 40 are adjacent to the downwardly extending sidewalls 50*a*, 50*b*. Specifically, the respective upper portions 52*a*, 53*a* and 52*b*, 53*b* of sidewalls 50*a* and 50*b*, when attached to the respective toe and heel plate flanges 32*a*, 32*b*, 42*a* and 42*b*, results in the depending members from the toe 30 and heel 40 plates having a relatively large lateral thickness (FIG. 7). This increased thickness improves the rigidity of the frame, which can result in corresponding improvements in skate speed and responsiveness.

A further advantage of the present invention is the ability to provide sidewalls 50*a*, 50*b* in different colors (see FIG. 6). This may be desirable to certain skaters, particularly members of a team that has specific "team" colors; each sidewall 50*a*, 50*b* can be colored differently to identify the members of competing teams. A particularly preferred coloring method is anodizing, which comprises electrically treating a sidewall so that a colored anodic coating is formed on the surface thereof. See generally N. Irving Sax and Richard J. Lewis, Sr., *Hawley's Condensed Chemical Dictionary* at 84 (11th ed. 1987) for a discussion of anodizing techniques. Prior art frames of one-piece construction cannot easily be provided with different colored sidewalls because masks must be used to ensure the different colors do not overlap during the coloring process.

Many modifications and other embodiments of the invention will come to the mind of one skilled in the art having the benefit of the teachings presented in the foregoing descriptions and associated drawings. Therefore, it is to be understood that the invention is not to be limited to the specific embodiments disclosed, and that modifications to the disclosed embodiments, as well as other embodiments, are intended to be included within the scope of the appended claims.

That which is claimed:

1. An in-line roller skate comprising:

a boot having a sole surface with toe and heel portions;

a frame comprising:

a toe plate having an upper, a lower, and a pair of lateral faces, said upper face being affixed to said sole surface toe portion;

a heel plate having an upper, a lower, and a pair of lateral faces, said upper face being affixed to said sole surface heel portion;

spaced-apart first and second downwardly extending sidewalls formed of a material different than said toe and heel plates, said sidewalls having inner and outer surfaces devoid of transverse projections; and fastening means for releasably attaching said first and second sidewalls to respective ones of said toe and heel plate lateral faces;

a plurality of axles mounted to and between said first and second sidewalls; and a plurality of wheels, each of which is rotatably mounted between said spaced-apart sidewalls on a respective axle.

2. An in-line roller skate according to claim 1, wherein said outer surface of said first sidewall comprises an anodic coating of a first color, and said outer surface of said second sidewall comprises an anodic coating of a second color, said second color being different from said first color.

3. An in-line roller skate according to claim 1, wherein said first and second sidewalls are substantially structurally identical.

4. An in-line roller skate according to claim 1, wherein said first and second sidewalls are formed of titanium.

5. An in-line roller skate according to claim 1, wherein said plurality of wheels comprises between three and six rotatably mounted wheels.

6. An in-line roller skate according to claim 1, wherein said fastening means comprises means configured so that said first sidewall is detachable from said heel and toe plates as said second sidewall is attached to said toe and heel plates.

7. An in-line roller skate comprising:

a boot having a sole surface with toe and heel portions;

a frame comprising:

a toe plate having an upper and a lower face, said upper face being affixed to said toe portion of said sole surface, said toe plate further including first and second laterally spaced-apart flanges extending downwardly from said toe plate lower face;

a heel plate having an upper and a lower face, said upper face being affixed to said heel portion of said sole surface, said heel plate further including first and second laterally spaced-apart flanges extending downwardly from said heel plate lower face;

a first downwardly-extending sidewall devoid of transverse projections that is releasably attached to a lateral face of each of said first toe and heel plate flanges;

a second downwardly-extendng sidewall devoid of transverse projections that is releasably attached to a lateral face of each of said second toe and heel plate flanges;

a plurality of axles mounted to and between said sidewalls; and a plurality of wheels, each of which is rotatably mounted between said sidewalls on a respective axle;

wherein said sidewalls are formed of a material which differs from and is more rigid than said toe and heel plates.

8. An in-line roller skate according to claim 7, wherein an outer surface of said first sidewall comprises an anodic coating of a first color, and an outer surface of said second sidewall comprises an anodic coating of a second color, said second color being different from said first color.

9. An in-line roller skate according to claim 7, wherein said first and second sidewalls are substantially structurally identical.

10. An in-line roller skate according to claim 7, wherein said first and second sidewalls are formed of titanium.

11. An in-line roller skate according to claim 7, wherein said plurality of wheels comprises between three and six rotatably mounted wheels.

12. An in-line roller skate according to claim 7, wherein said first sidewall is detachable from said heel and toe plates as said second sidewall is attached to said toe and heel plates.

* * * * *